US005444898A

United States Patent [19]

Norvell

[11] Patent Number: 5,444,898

[45] Date of Patent: Aug. 29, 1995

[54] WATER-RESISTANT CLOSURE

[75] Inventor: Jean Norvell, Newark, Del.

[73] Assignee: W. L. Gore & Associates, Inc., Newark, Del.

[21] Appl. No.: 215,195

[22] Filed: Dec. 20, 1993

Related U.S. Application Data

[63] Continuation of Ser. No. 959,832, Oct. 13, 1992, abandoned.

[51] Int. Cl.[6] ..... A44B 19/32

[52] U.S. Cl. ..... 24/389; 24/432

[58] Field of Search ..... 24/384, 389, 397, 398, 24/394, 432

[56] References Cited

U.S. PATENT DOCUMENTS

| | | | |
|---|---|---|---|
| 2,532,724 | 12/1950 | Krupp | 24/389 |
| 3,624,871 | 12/1971 | Osterkorn . | |
| 3,962,729 | 6/1976 | Cook | 24/432 X |
| 4,461,098 | 7/1984 | Diegelman | 2/61 X |
| 4,601,085 | 7/1986 | Yoshida et al. | 24/384 |
| 4,888,859 | 12/1989 | Honta | 24/389 |
| 5,129,127 | 7/1992 | Hamatani | 24/394 |
| 5,159,719 | 11/1992 | Aumann . | |

FOREIGN PATENT DOCUMENTS

| | | |
|---|---|---|
| 834554 | 2/1952 | Germany . |
| 607586 | 9/1948 | United Kingdom . |
| 2046171 | 11/1980 | United Kingdom . |
| 9307776 | 4/1993 | WIPO . |

*Primary Examiner*—James R. Brittain
*Attorney, Agent, or Firm*—Gary A. Samuels

[57] ABSTRACT

A water-resistant closure possessing a layer of waterproof material having an opening is disclosed. Attached within the opening is a slide fastening assembly comprising a pair of stringer tapes of a waterproof fabric. At least one stringer tape is longitudinally folded so as to form an internal flap positioned behind the inside surface of the other stringer tape. The internal flap blocks the entry of water which has passed through gaps present in the slide fastener device. An attaching structure secures the slide fastening assembly in the opening and a sealing tape covers the attaching structure and seals the stringer tape to the waterproof material forming the water-resistant garment closure.

An article containing the water-resistant garment closure is also disclosed.

9 Claims, 4 Drawing Sheets

WATER-RESISTANT CLOSURE

This is a continuation of application Ser. No. 07/959,832, filed Oct. 13, 1992, now abandoned.

FIELD OF THE INVENTION

The invention relates to a water-resistant closure, more particularly to a water-resistant closure containing a slide fastener having interlocking elements attached to waterproof fabric tapes which are folded behind a gap formed between the interlocking elements of the slide fastener and secured within a water-resistant article.

BACKGROUND OF THE INVENTION

Water resistant articles such as jackets, coats, pants and the like have generally been produced from materials made of rubber, waterproof plastics or coated fabrics. The rubber, waterproof plastics or coated fabrics generally used to fabricate water-resistant articles have been impermeable to water vapor as well as liquid water. Water-resistant articles fabricated from these materials have limited comfort since perspiration produced by one wearing an article is trapped within the article.

For some years, water-resistant articles have been produced from materials which permit passage of water vapor while preventing passage of liquid water. These articles exhibit increased comfort in wear by permitting moisture vapor created by the wearer's perspiration to escape from within the article while in use. An example of this material is a breathable waterproof laminated fabric containing a layer of expanded porous polytetrafluoroethylene (PTFE) coated with a breathable polyurethane polymer as described in Gore & Allen U.S. Pat. No. 4,194,041.

In order to construct water-resistant articles of waterproof material, waterproof material is cut into pattern pieces and sewn together producing the article's shape. Care must be taken in the design of water-resistant articles to allow sealing of seams present in the waterproof material used to form the article. Care must also be taken in design and placement of closures present in water-resistant articles to facilitate donning and doffing of these articles. Closures containing snaps, buttons or slide fasteners have been used in the design of water-resistant articles. In the case of closures of slide fasteners having teeth, and attached with fabric stringer tapes, liquid may pass between gaps in the teeth of the slide fastener or between the fibers of the fabric stringer tapes. Liquid may also wick tangentially along the fabric surface of the stringer tape thereby entering the article where the slide fastener assembly is attached to the article. It will also pass via the needle holes when thread is used as the method of attaching the stringer tapes to the article.

Water-resistant articles have additionally required a storm fly flap or flaps to be placed externally over the closures to prevent the closures from coming in direct contact with a forceful spray of liquid and allowing liquid to pass between gaps in the closure. However, storm fly flaps are bulky, require sewing and sealing to the article to be effective, and are aesthetically limiting to article manufacturers desiring to design water-resistant articles.

It is to the production of a simple, effective, water-resistant closure that the instant invention is directed.

BRIEF DESCRIPTION OF THE INVENTION

A water-resistant closure is disclosed which contains a layer of waterproof material having two parallel longitudinal edges which define an opening. The waterproof material has an inside surface and an outside surface. A slide fastening assembly is attached to the inside surface of the layer of waterproof material within the opening in the waterproof material and in parallel arrangement to the parallel longitudinal edges of the opening in the waterproof material.

A means for attaching the slide fastening assembly to the layer of waterproof material and a sealing tape covering and sealing the means for attaching the slide fastening assembly attachment are also present. A portion of the slide fastening assembly adjacent to the means for attaching the slide fastening assembly and a portion of the inside surface of the layer of waterproof material adjacent to the slide fastening assembly are covered by sealing tape which forms a water-resistant seal between the slide fastening assembly and the layer of waterproof material.

The slide fastening assembly has a first stringer tape and a second stringer tape of a waterproof fabric in a parallel arrangement with one another. The stringer tapes have an inside surface and an outside surface, an inside edge and an outside edge, and a series of cooperating slide fastener elements comprising a set of such elements on each inside edge of the stringer tapes. A slider cooperates with the sets of fastener elements on the stringer tapes to open and close the slide fastening device.

The first stringer tape is longitudinally folded back upon itself to form a flap such that the outside edge of the first stringer tape is adjacent the inside surface of the second stringer tape and positioned so that the series of cooperating slide fastener elements is covered by the internal flap.

An article containing the instant water-resistant closure is also disclosed.

DETAILED DESCRIPTION OF THE INVENTION

Figure 1:
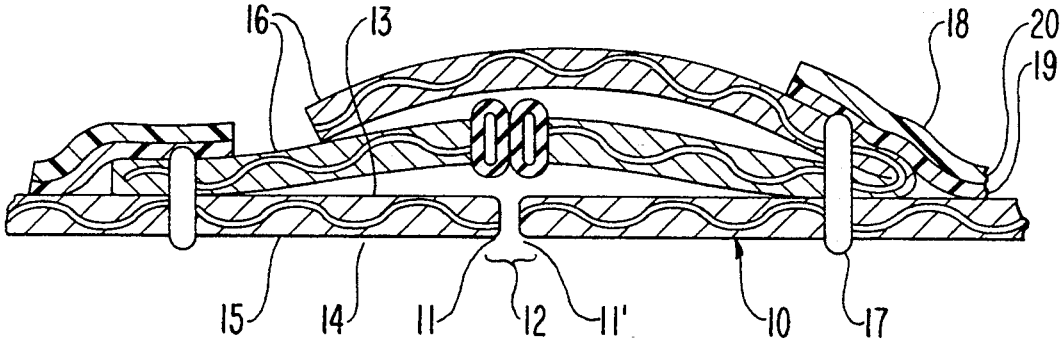
FIG. 1 depicts a cross-sectional view of an embodiment of the instant water-resistant closure.

Referring to FIG. 1, a water-resistant closure 10 is depicted. The water-resistant closure comprises a layer of waterproof material 15 having two parallel longitudinal edges 11 and 11' which define an opening 12. The layer of waterproof material has an inside surface 13 and an outside surface 14.

The layer of waterproof material is selected from the group consisting of rubber, waterproof plastic, coated fabric and laminated fabric. Preferably, the waterproof material is a breathable waterproof material. A material is defined herein as "breathable" if it exhibits a water vapor-transmission rate (WVTR) of 50 g/($m^2 \times 24$ hr.) or greater as determined by the water vapor-transmission rate test described herein. Breathable waterproof materials include fabrics coated with a breathable polymer. An example of a breathable polymer is a polyurethane taught in Henn U.S. Pat. No. 4,532,316.

A breathable waterproof material may also be a fabric laminate where a breathable waterproof membrane is laminated to a fabric. The breathable waterproof membrane is selected from the group consisting of polyurethane, polyester, polyethers, polyamides, polyacrylates, copolyether esters, copolyether amides, and fluoropolymers. Preferably, the breathable membrane is a membrane of porous polytetrafluoroethylene (PTFE) more preferably a membrane of expanded porous PTFE produced by the process taught in Gore U.S. Pat. No. 3,953,566 or a membrane of porous expanded polytetrafluoroethylene coated with a breathable polyurethane polymer as described in Gore and Allen U.S. Pat. No. 4,194,041, or the like.

Still referring to FIG. 1, a slide fastening assembly 16 is depicted as being attached to the inside surface 13 of the waterproof material 15 in a parallel arrangement to the parallel longitudinal edges 11 and 11' of the opening 12 in the waterproof material.

Still referring to FIG. 1, a means for attaching 17 the slide fastener assembly 16 to the layer of waterproof material 15 is depicted. The means of attaching the slide fastener assembly is most commonly a stitch but may also be an adhesive or a tape containing an amount of an adhesive, or fusion bonding, ultrasonic welding, and the like.

Still referring to FIG. 1, a sealing tape 18 covering and sealing the stitch 17 which attaches the slide fastening assembly 16 to the layer of waterproof material 15 is depicted. The sealing tape covers and seals a portion of the slide fastening assembly adjacent to the means for attaching the slide fastening assembly and a portion of the inside surface of the layer of waterproof material adjacent to the slide fastening assembly. The sealing tape 18 is composed of a thermoplastic polymeric adhesive layer 19 and a backing layer 20. The thermoplastic polymeric adhesive layer can be selected from the group consisting of polyvinyl halide, polyurethane, polyolefin, polyamide, polyester, polyether, fluoropolymers, and the like. Preferably, the thermoplastic polymeric adhesive layer 19 is a polyurethane and the backing layer 20 is a porous polymeric membrane. The porous polymeric membrane preferably is porous PTFE, more preferably porous expanded PTFE having a structure of nodes interconnected by fibrils and produced by the process as taught in Gore U.S. Pat. No. 3,953,566.

Alternatively, the backing layer 18 may be a fabric laminate comprised of a porous polymeric membrane laminated to a fabric layer.

Figure 2:
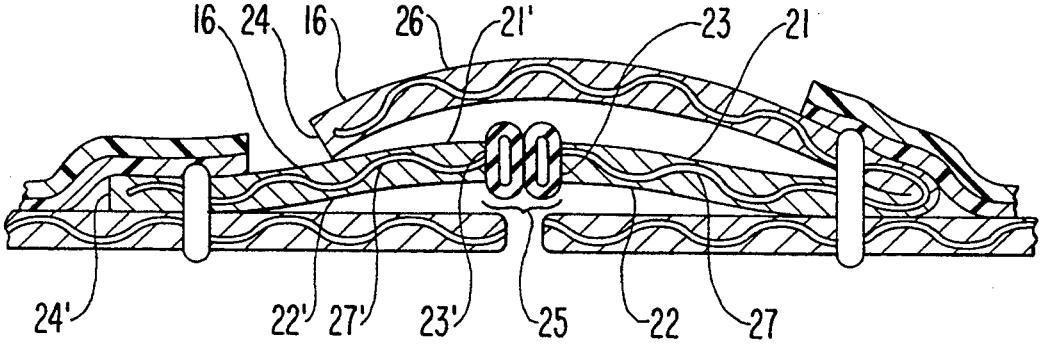
FIG. 2 depicts another cross-sectional view of the embodiment of the instant water-resistant closure depicted in FIG. 1.

Referring now to FIG. 2, the slide fastening assembly 16 has a first stringer tape 27 and a second stringer tape 27'. Both of the stringer tapes 27 and 27' are of a waterproof fabric, and are in a parallel arrangement with one another. Both of the stringer tapes have an inside surface 21 and 21', an outside surface 22 and 22', an inside edge 23 and 23', and an outside edge 24 and 24'. A slide fastening device 25 having a series of cooperating slide fastener elements comprising a set of such elements mounted on each inside edge 23 and 23' of the stringer tapes are also depicted. The series of cooperating slide fastener elements may be in the form of a coil, a series of teeth, or a series of scoops. The series of cooperating fastener elements may be a metal such as steel or brass or a plastic such as polyamide, polyester or polyvinyl chloride.

Still referring to FIG. 2, the waterproof fabric of the stringer tapes 27 and 27' may be composed of a knitted, woven or non-woven fabric, or, as previously disclosed, a fabric laminate having a breathable waterproof membrane laminated to a fabric. The knitted, woven or non-woven fabric of the stringer tapes are coated on one or both sides with a polymeric material, preferably a breathable polymeric material, to make them the waterproof. Preferably, the polymeric material is coated on the inside surface and outside surface of the stringer tapes to prevent water from passing through the fabric of the stringer tapes. The polymeric material coated on the inside surface and outside surface of the stringer tapes also prevents water from wicking in a tangential direction along the stringer tapes.

The polymeric material may be coated on the stringer tapes in various manners known in the art. The polymeric material may be dissolved in an appropriate solvent and brushed, dipped or sprayed onto the stringer tapes. Alternately, the polymeric material may be extruded onto the stringer tapes. Preferably, the polymeric material is in tape form and is melted and pressed onto the inside and outside surfaces of the stringer tapes.

Polymeric materials having utility in the instant invention are selected from the group consisting of polyurethane, polyamide, polyolefin, polyester, polyvinyl halide, natural rubber, nitrile rubber, butyl rubber, and fluoropolymers. The preferred polymeric material is polyurethane. The polymeric material coated on the inside surface of the stringer tapes is not necessarily the identical polymeric material coated on the outside surface of the stringer tapes.

When the waterproof fabric is in the form of a waterproof fabric laminate, where a waterproof membrane, preferably a breathable waterproof membrane, is laminated to a fabric, the breathable waterproof membrane is selected from the group consisting of polyurethane, polyester, polyethers, polyamides, polyacrylates, copolyether esters, copolyether amides, and fluoropolymers. Preferably, the breathable membrane is a membrane of porous polytetrafluoroethylene, more preferably a membrane of porous expanded polytetrafluoroethylene as produced by the process taught in Gore U.S. Pat. No. 3,953,566. Most preferably the waterproof fabric consists of a porous expanded polytetrafluoroethylene membrane having a breathable polyurethane polymer coating; the coated membrane laminated to woven, knitted, or non-woven fabric.

Still referring to FIG. 2, the first stringer tape 27 is depicted as being longitudinally folded back upon itself to form a flap 26. The flap 26 extends past the slide fastener elements 25 so that the outside edge 24 of the first stringer tape 27 is positioned adjacent the inside surface of the second stringer tape 21, thus covering the inside surface of the series of cooperating slide fastener elements 25. To produce the flap 26, the first stringer tape 27 must be sufficiently wide to permit the first stringer tape 27 to be folded back upon itself in the above-described manner.

Figure 3:
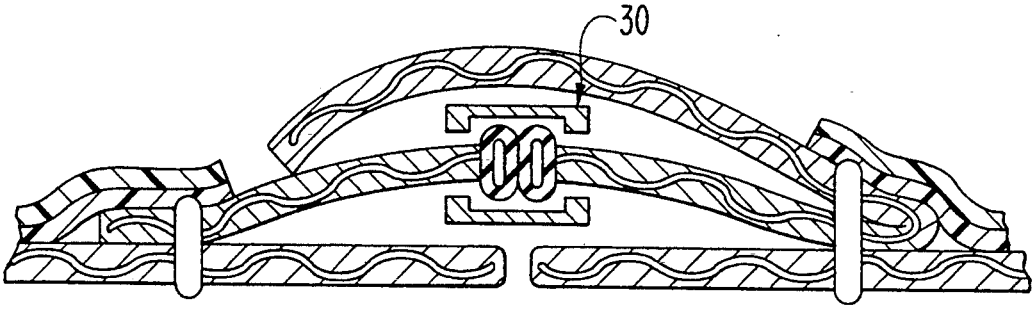
FIG. 3 depicts another cross-sectional view of the embodiment of the instant water-resistant closure depicted in FIG. 1.

Referring now to FIG. 3, a slider 30 cooperating with the sets of fastener elements on the stringer tapes to open and close the slide fastening device is depicted.

Figure 4:
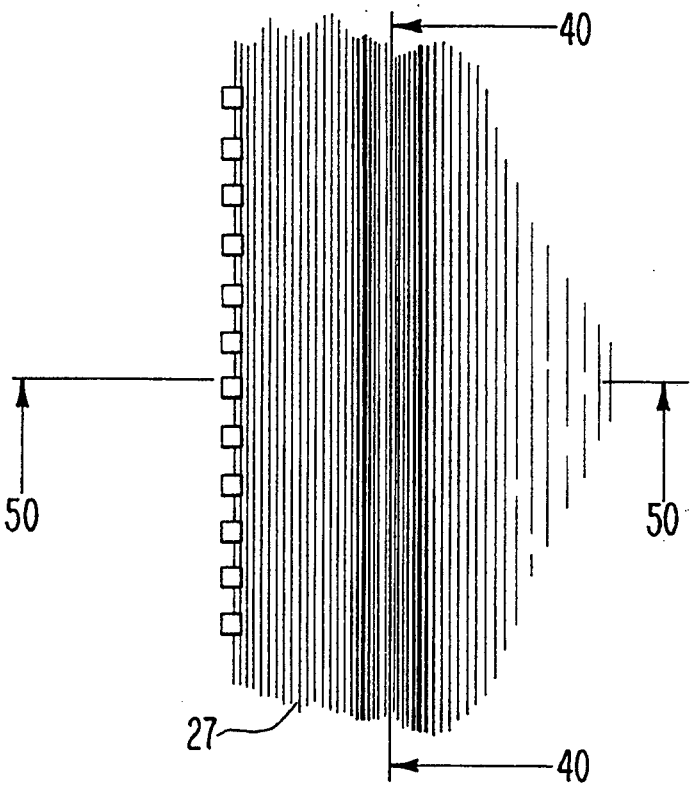
FIG. 4 depicts a plain view of a segment of a first stringer tape 27 of the instant water-resistant closure.
Figure 5:
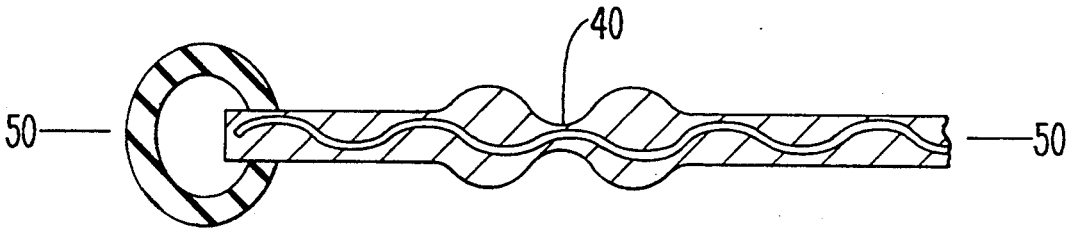
FIG. 5 depicts a cross-sectional view of the first stringer tape 27 taken along line 50—50 of FIG. 4.

Referring now to FIG. 4, the first stringer tape 27 may be produced so that it has a predisposition to fold along a predetermined line 40. Referring now to FIG. 5, the predetermined line 40 may be produced when a stringer tape is fabricated having an area of relatively greater flexibility bounded by areas of relatively lesser flexibility. One method of producing an area of relatively greater flexibility bounded by an area of relatively lesser flexibility is by having a fabric of a stringer tape with an area of decreased amount of fibers bounded by an area of increased amount of fibers.

An advantage of closures having internal flaps rather than external storm fly flaps is if water is able to pass between gaps present between the series of cooperating slide fastener elements, it will be prevented from penetrating further and will be channeled harmlessly along the surface of the flap formed by the inside surface of the first stringer tape.

Another advantage of closures having internal flaps rather than external storm fly flaps, is since the flap is formed by longitudinal folding of the first stringer tape, alignment of the flap with the series of cooperating slide fastener elements is easily attained.

Still another advantage of closures having internal flaps, rather than external storm fly flaps, is that the stringer tapes, the slider, and the series of cooperating slide fastener elements can be simultaneously dyed so each element achieves a similar color. Flaps would thus be of a similar color to the other elements in the slide fastening assembly and, therefore, make the internal flaps less noticeable in an article than an external storm fly flap.

Figure 6:
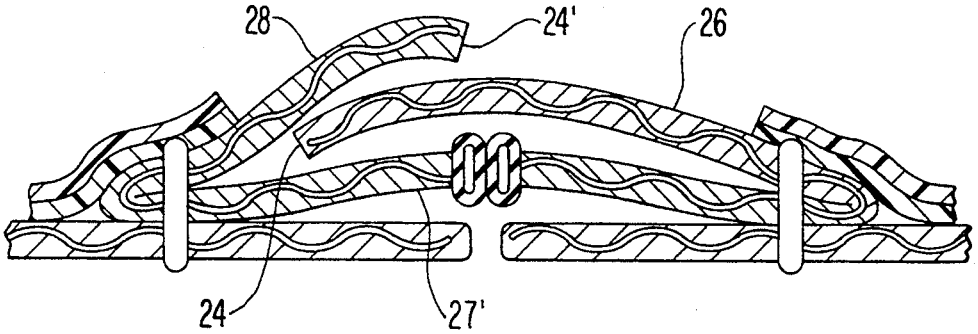
FIG. 6 depicts a cross-sectional view of another embodiment of the instant water-resistant closure.

Referring now to FIG. 6, an alternate embodiment of the inventive water-resistant closure is depicted. In this embodiment, the second stringer tape 27′ is also longitudinally folded back upon itself to form a second flap 28 in such a manner that the outside edge 24′ of the second stringer tape 27′ extends past the outside edge 24 of the first stringer tape thus covering the end of the first flap 26.

Figure 7:
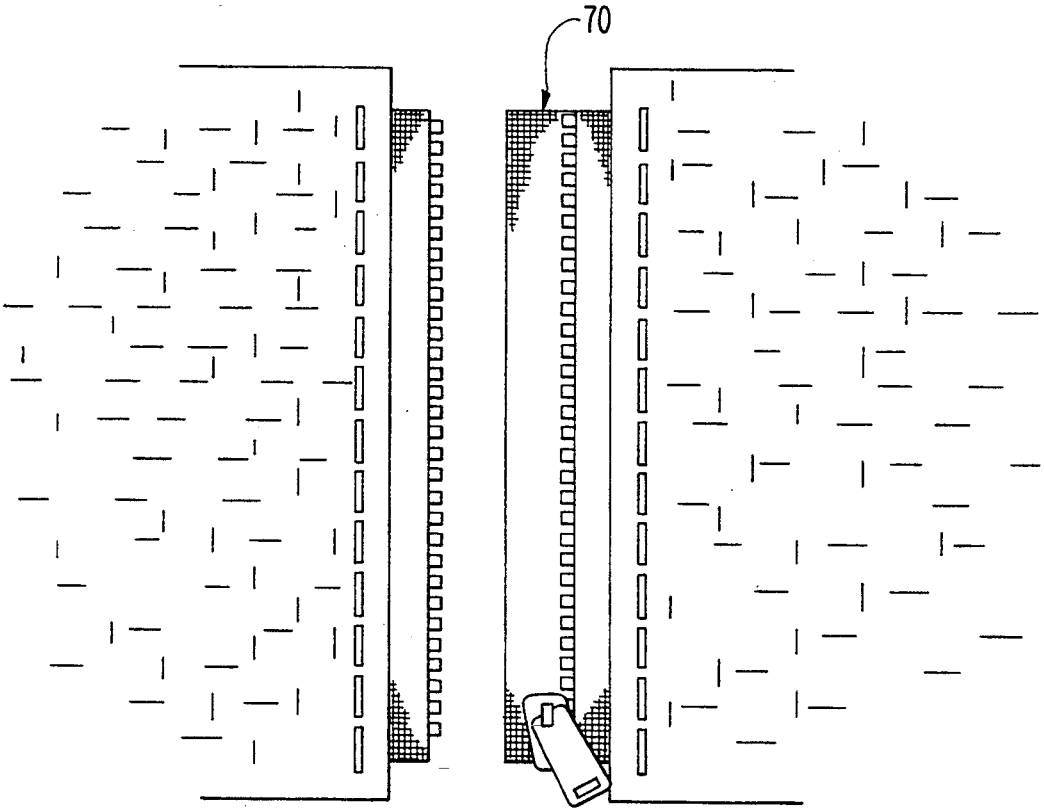
FIG. 7 depicts a plain view of a separating water-resistant closure.
Figure 8:
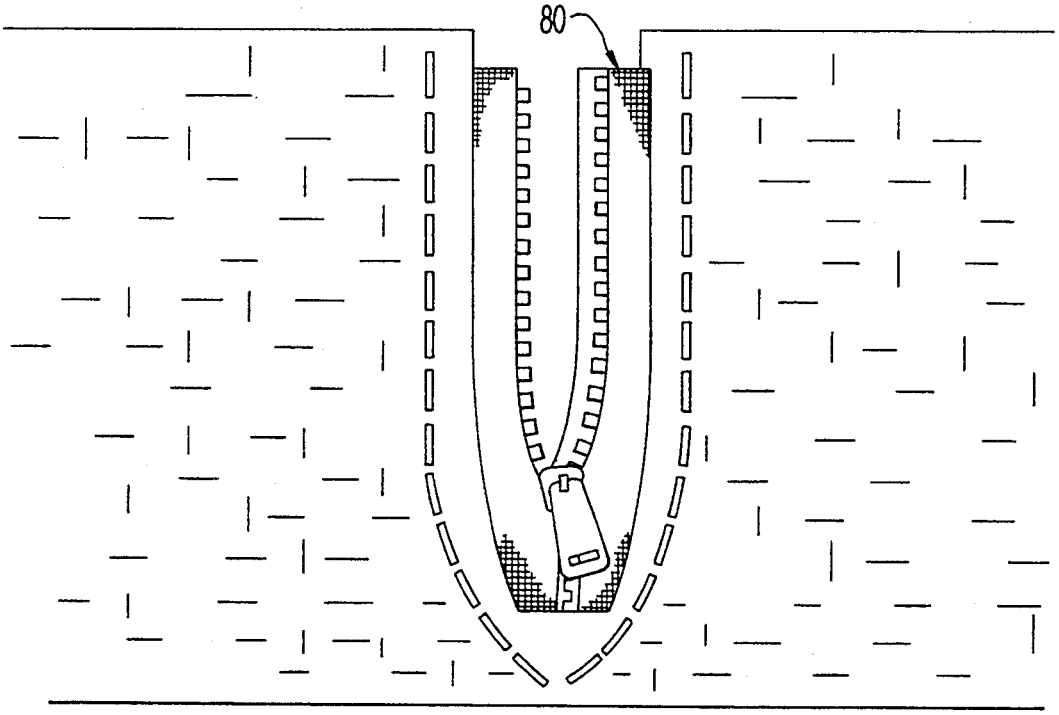
FIG. 8 depicts a plain view of a non-separating water-resistant closure.

The water-resistant closure may be in the form of a separating slide fastener 70, as depicted in FIG. 7 or in the form of a non-separating slide fastener 80 as depicted in FIG. 8.

Articles which contain the water-resistant closure are fabricated from a layer of waterproof material, as previously defined herein, using assembly techniques known in the art such as, for example, cutting the layer of waterproof material into shapes and sewing the shapes together to form an article. Seams formed in the waterproof layer through sewing may be sealed using sealing techniques known in the art such as, for example, sealing with a sealing tape as previously defined herein.

Figure 9:
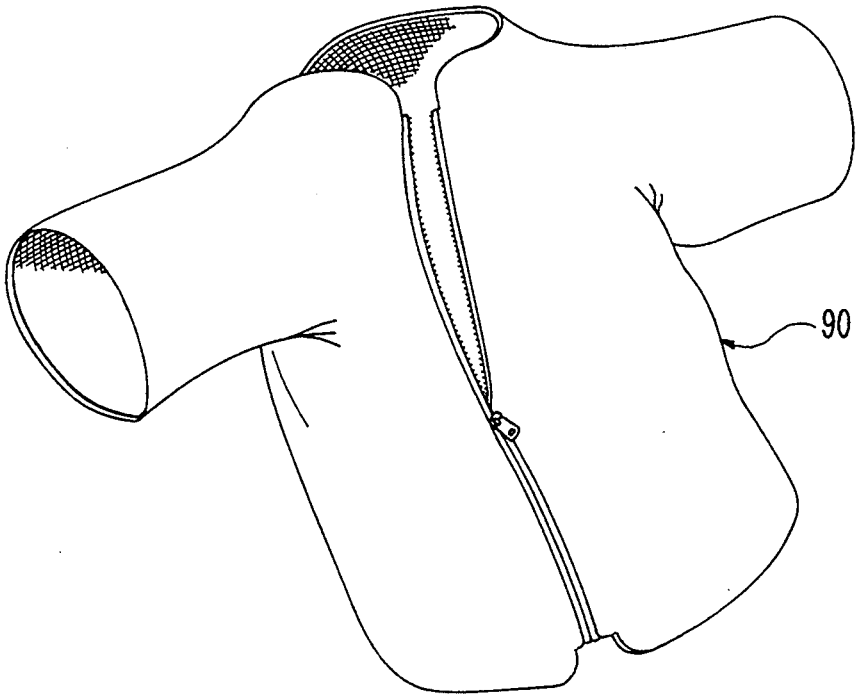
FIG. 9 depicts an article containing a water-resistant closure of the instant invention.

An example of an article 90 containing the water-resistant closure is depicted in FIG. 9. The term "article" is defined herein to include coats, pants, gloves, hats, boots, shoes, socks, tents, sleeping bags and luggage, and is not limited to the embodiment depicted in FIG. 9.

TEST DESCRIPTION

WATER VAPOR TRANSMISSION RATE (W.V.T.R.)

A description of the test employed to measure water vapor transmission rate (WVTR) is given below. The procedure has been found to be suitable for testing the materials and products of this invention.

In the procedure, approximately 70 ml of a solution consisting of 35 parts by weight of sodium chloride and 15 parts by weight of distilled water was placed into a 133 ml polypropylene cup, having an inside diameter of 6.5 cm at its mouth.

An expanded polytetrafluoroethylene (PTFE) membrane having a WVTR of approximately 34,200 g/($m^2 \times 24$ hr) as tested by the method described in Crosby U.S. Pat. No. 4,862,730, and available from W. L. Gore & Associates, Inc. of Newark, Delaware, was heat sealed to the lip of the cup to create a taut, leakproof, porous barrier containing the solution. A similar expanded PTFE membrane was mounted to the surface of a water bath. The water bath assembly was controlled at 23° C. plus or minus 0.2° C., utilizing a temperature controlled room and a water-circulating bath.

The sample to be tested was allowed to condition at a temperature of 23° C. and a relative humidity of 50% prior to performing the test procedure. Samples were placed in contact with the expanded polytetrafluoroethylene membrane mounted to the surface of the water bath.

The cup assembly was weighed to the nearest 1/1000 g and was placed in an inverted manner onto the center of the test sample.

Water transport was provided by the driving force between the water in the water bath and the saturated salt solution providing water flux by diffusion in that direction. The sample was tested for 15 minutes and the cup assembly was then removed, weighed again within 1/1000 g.

The WVTR of the sample was calculated from the weight gain of the cup assembly and was expressed in grams of water per square meter of sample surface area per 24 hours.

WATER RESISTANCE TEST

The water resistance of a closure is determined through the following method. A closure is incorporated into a garment, such as a coat or parka, fabricated from waterproof material.

The garment is fitted upon a mannequin of an appropriate size for the garment. A bag or hood is placed over the head of the mannequin and sealed within the neck opening of the garment to prevent entry of water through the neck opening of the garment.

Water is sprayed upon the garment from an overhead nozzle to simulate a rainfall of approximately 7.6 cm/hr. at a velocity of 6.98 m/sec. A second nozzle is positioned 45.7 cm from the closure. The second nozzle is positioned slightly downward so to strike the closure at an approximate 45° angle. Water is sprayed through the second nozzle to simulate a rainfall of 55.9 cm/hr at a velocity of 19.45 m/sec.

While water is sprayed on the garment, the mannequin is rotated back and forth upon its axis through 180°. One cycle is completed every 20 seconds.

At the end of sixty minutes, the water sprays are turned off, and the inside of the garment is inspected for the presence of water. If no water is detected, the closure is rated as "water-resistant."

WATERPROOFNESS TESTING

Samples of materials are tested for waterproofness by using a modified Suter test apparatus which is a low water entry pressure challenge. Water is forced against a sample area of 7.62 cm diameter sealed by two rubber gaskets in a clamped arrangement. The sample is open to atmospheric conditions and is visible to the operator. The water pressure on the sample is increased to 40 kPa by a pump connected to a water reservoir, as indicated by an appropriate gauge and regulated by an in-line valve. The test sample is at an angle and the water is recirculated to assure water contact and not air against the samplers lower surface. The upper surface of the sample is visually observed for a period of 3 minutes for the appearance of any water forced through the sample. Liquid water seen on the surface is interpreted as a leak. A sample achieves a passing grade when no liquid water visible after 3 minutes. Passing this test is the definition of "waterproof" as used herein.

The following example is presented to further explain the teachings of the instant invention and not to limit the scope of the invention. Various modifications and equivalents will readily suggest themselves to those of ordinary skill in the art without departing from the spirit and scope of the instant invention.

EXAMPLE 1

A jacket was made of waterproof material (GORE-TEX® fabric laminate available from W. L. Gore & Associates, Inc., Elkton, Md.) consisting of a porous expanded polytetrafluoroethylene membrane having a coating of breathable polyurethane polymer, and having a fabric laminated to the coated membrane.

A separating slide fastener assembly having non-waterproof stringer tapes was obtained. A tape of thermoplastic polyurethane polymer 0.09 millimeters (0.0035 inches) in thickness (GORE-BOND® adhesive, available from W. L. Gore & Associates, Inc., Elkton, Md.) was applied to both surfaces of each stringer tape using heat and pressure. The tape of polyurethane adhesive was applied up to but not covering the slide fastener elements so that the slider could move freely up and down the fastener elements without being impeded by the polyurethane adhesive.

In order to increase the width of the stringer tapes from 1.2 centimeters (0.5 inches) to 4.4 centimeters (1.75 inches) a strip of waterproof fabric laminate, (GORE-TEX® fabric laminate available from W. L. Gore & Associates, Inc., Elkton, Md.), was sewn on to them. The waterproof fabric laminate was composed of a layer of porous expanded polytetrafluoroethylene , a fabric and a second layer of porous expanded polytetrafluoroethylene with a polyurethane coating thereon. The waterproof fabric laminate was placed in a dye both to match the color of the stringer tapes of the separating slide fastener.

The fastener assembly, with the first stringer tape longitudinally folded back upon itself to form a flap of waterproof fabric laminate, was sewn into the front opening of the jacket of waterproof material so that only one stitch line was required. A cotton covered polyester thread was used at 3–4 stitches per cm.

In like manner, the second stringer tape was longitudinally folded back upon itself to form a flap and sewn into place on the opposing side of the jacket opening so that, when the opening was closed by engaging the slide fastener, the flap of the second stringer tape extended past and covered the end of the first stringer tape (as shown in FIG. 6).

Subsequently, the stitch lines were sealed using a 0.4 millimeters (0.016 inches) thick thermoplastic polyurethane seam sealing tape (GORE-SEAM® tape, available from W. L. Gore & Associates, Inc., Elkton, Md.). The seam sealing tape was arranged so that thermoplastic polyurethane covered the stitching and the adjacent portion of the waterproof fabric laminate. Heat and pressure were used to melt the thermoplastic polyurethane and effect the seal.

The jacket was mounted on a mannequin and subjected to the Water Resistance Test described hereinabove. At the end of the test period the inside of the jacket was examined. No water had penetrated past the internal flaps and the inside of the jacket was dry.

Other embodiments of the invention will be apparent to those skilled in the art from a consideration of this specification or practice of the invention disclosed herein. It is intended that the specification and examples be considered as exemplary only, with the true scope and spirit of the invention being indicated by the following claims.

I claim:

1. A water-resistant closure comprising:

(a) a layer of waterproof material selected from the group consisting of rubber, waterproof plastic, coated fabric, and laminated fabric, said waterproof material having two parallel longitudinal edges which define an opening in the waterproof material and having an inside surface and an outside surface;

(b) a longitudinally disposed slide fastening assembly comprising a slide fastening device having a series of cooperating slide fastener elements, and having a first and a second stringer tape positioned and attached longitudinally on either side of said slide fastening device, said stringer tapes each being attached on opposing sides of the opening on the inside surface of the waterproof material so as to cover the opening in the waterproof material;

(c) sealing tape comprising thermoplastic polymeric adhesive, covering and sealing each boundary formed at the point of attachment of each stringer tape and the inside surface of the adjacent layer of waterproof material;

said stringer tapes comprising a waterproof fabric, and said first stringer tape being longitudinally folded back upon itself to form a flap which covers the series of cooperating slide fastener elements.

2. A water-resistant closure as in claim 1 further comprising the second stringer tape longitudinally folded back upon itself to form a second flap which covers the outside edge of the first stringer tape.

3. A water-resistant closure as in claims 1 or 2, wherein the waterproof fabric of the stringer tapes is coated with a polymeric material selected from the group consisting of polyurethane, polyamide, polyolefin, polyester, polyvinyl halide, natural rubber, nitrile rubber, butyl rubber, and fluoropolymers.

4. A water-resistant closure as in claim 3 wherein the polymeric material is polyurethane.

5. A protective article which contains the water-resistant closure as in claim 4.

6. A water-resistant closure as in claim 3 wherein the layer of waterproof material is a laminated fabric comprising a porous expanded polytetrafluoroethylene membrane having a breathable polyurethane coating; said membrane laminated to a woven, knitted, or nonwoven fabric.

7. A protective article which contains the water-resistant closure as in claim 6.

8. A protective article which contains the water-resistant closure as in claim 3.

9. A protective article which contains the water-resistant closure as in claims 1 or 2.

* * * * *